US005724063A

United States Patent [19]

Chee et al.

[11] Patent Number: 5,724,063

[45] Date of Patent: Mar. 3, 1998

[54] COMPUTER SYSTEM WITH DUAL-PANEL LCD DISPLAY

[75] Inventors: Lawrence Chee, Vancouver; David Mulvenna, Delta, both of Canada

[73] Assignee: Seiko Epson Corporation, Tokyo, Japan

[21] Appl. No.: 487,120

[22] Filed: Jun. 7, 1995

[51] Int. Cl.[6] ..... G09G 3/36

[52] U.S. Cl. ..... 345/103

[58] Field of Search ..... 345/1, 103, 903; 348/383

[56] References Cited

U.S. PATENT DOCUMENTS

| | | | |
|---|---|---|---|
| 4,399,435 | 8/1983 | Urabe . | |
| 4,550,386 | 10/1985 | Hirosawa et al. . | |
| 4,766,427 | 8/1988 | Abe et al. . | |
| 4,924,432 | 5/1990 | Asai et al. . | |
| 5,018,076 | 5/1991 | Johary et al. . | |
| 5,136,282 | 8/1992 | Inaba et al. | 345/103 |
| 5,309,168 | 5/1994 | Itoh et al. . | |
| 5,448,257 | 9/1995 | Margeson, III et al. | 345/103 |

FOREIGN PATENT DOCUMENTS

| | | |
|---|---|---|
| 0 283 235 | 9/1988 | European Pat. Off. . |
| 0 591 682 | 4/1994 | European Pat. Off. . |
| 33 47 345 | 7/1984 | Germany . |
| 35 33 869 | 3/1986 | Germany . |

*Primary Examiner*—Jeffery Brier
*Attorney, Agent, or Firm*—W. Glen Johnson

[57] ABSTRACT

A computer system includes a dual-panel monochrome or color liquid crystal display (LCD). A dynamic random access memory (DRAM) of the computer includes a defined virtual memory array representative of pixel locations of the dual-panel LCD. Pixel values are read from the virtual array of the DRAM and written to corresponding locations of the display by a display pipeline. The writing of pixel values to the display proceeds pixel-by-pixel across a row of pixels in a panel, and then to the next row of pixels until a panel is refreshed. The panels of the array are refreshed one at a time alternating between an upper panel of the display and a lower panel of the display. While one panel is being refreshed, the other panel is blanked. Consequently, the dual-panel display may be driven with a simplified structure of display pipeline, and with a reduced time requirement for access to the DRAM.

26 Claims, 1 Drawing Sheet

COMPUTER SYSTEM WITH DUAL-PANEL LCD DISPLAY

CROSS REFERENCE TO RELATED APPLICATIONS

The subject matter of the present application is related to subject matter disclosed in U.S. patent application Ser. No. 08/487,117, entitled "Computer System with Display", in application Ser. No. 08/485,876, entitled "Memory Request and Control Unit including a Mechanism for Issuing and Removing Request for Memory Access" in U.S. patent application Ser. No. 08/486,796, entitled "Computer System with Double Simultaneous Displays Showing Differing Display Images", and in U.S. patent application Ser. No. 08/487,121, entitled "Computer System with Video Display Controller having Power Saving Modes", all filed on the same day and assigned to the assignee of the present application.

BACKGROUND OF THE INVENTION

1. Field of the Invention

The present invention is in the field of computer systems. More particularly, the present invention relates to computer systems of the type using a liquid crystal display (LCD), also generally referred to as a "flat panel" type of display. Still more particularly, the present invention relates to such a computer system having a monochrome or color LCD of dual-panel type. Usually, such computer systems are battery powered portable devices of the notebook configuration, although this is not necessarily the case.

2. Related Technology

A conventional computer system using a cathode ray tube (CRT) type of display is known in accord with U.S. Pat. No. 4,399,435 (hereinafter, the '435 patent), issued 16 Aug. 1983 to Kiichiro Urabe. It is believed that according to the '435 patent, a computer may use a CRT type of display with digital data for the display being stored in a refresh memory. The data from the refresh memory is converted by a character generator into patterns to be displayed on a CRT screen. A buffer memory is employed which is capable of storing at least two rows of data for the CRT. During the fly back period of the CRT display, the data is read from the buffer memory, and fresh data is written from the refresh memory into the buffer memory.

The display according to the '435 patent is limited to use with a CRT display. Accordingly, it is believed that the teaching of the '435 patent is not usable with modern portable battery-powered computers, and especially not with those of the notebook type.

Another conventional computer system is known in accord with U.S. Pat. No. 4,550,386 (hereinafter, the '386 patent), issued 29 Oct. 1985 to Toshio Hirosawa, et.al. It is believed that according to the '386 patent, a network terminal operation controller allows a single terminal of the CRT type to display data from two programs in a split screen format. The programs need not be modified in order to display data from these programs on a single CRT displaying a split screen. However, the teaching of the '386 patent is also thought to be specific to a CRT display device, and to be not applicable to portable computers using a LCD display.

Still another conventional computer system is known in accord with U.S. Pat. No. 4,766,427 (hereinafter, the '427 patent), issued 23 Aug. 1988 to Yoshio Abe, et.al. It is believed that according to the teaching of the '427 patent, a CRT display can simultaneously display text and graphics in a split screen format. Again, this teaching appears to be specific to a CRT type of display, and is not applicable to a LCD display.

Another conventional computer system which may use either a CRT or LCD type of display is known in accord with U.S. Pat. No. 4,924,432 (hereinafter, the '432 patent), issued 8 May 1990 to Nobuteru Asai, et.al. It is believed that according to the teaching of the '432 patent, a display information processing unit stores dot data to be displayed in an even-address graphic memory, and in an odd-address graphic memory. When data to be refreshed on the display bridges across two adjacent addresses, having different odd/even addresses, the CPU generates the address of the odd-address dot data, and a peripheral control circuit generates the address of the even-address dot data so that the dot data can be accessed for refreshing the display in only a single memory access. This teaching does not appear to relate to a dual panel LCD display, nor to refreshing data displayed on this dual panel LCD display.

A more recent conventional computer system display technology is known in accord with U.S. Pat. No. 5,018,076 (hereinafter, the '076), issued 21 May 1991 to Arun Johary, et.al. It is believed that according to the teaching of the '076 patent a flat-panel dual-panel bit-map type of display has pixels which will fade after being refreshed. Accordingly, these pixels need to be refreshed more frequently than the display is updated (i.e., has fresh data written to it) to prevent visible flicker of the display. In order to refresh these pixels of the dual-panel display at a sufficiently fast rate, the '076 patent teaches to use two address generators and several buffer memories. The addresses generated are alternated between the upper addresses and lower addresses for upper and lower panels of the display on a flip-flop basis during alternate frames of the display.

According to the '076 patent, the use of dual address generators to drive the panels of the display in flip-flop fashion during alternate frames of the display is more advantageous than the use of a single address generator. However, the '076 patent requires the use of a considerable number of duplicated circuit sections, which increases the cost and complexity of a computer system using this teaching.

Still another conventional teaching relating to flat panel displays for a computer system is found in U.S. Pat. No. 5,309,168 (hereinafter, the '168 patent), issued 3 May 1994 to Shuhei Itoh, et.al. It is believed that according to the teaching of the '168 patent, a CRT controller and a program used to generate data directed to a CRT display may be used with a LCD flat panel display of the double-panel type having a different timing requirement than does the CRT. In order to achieve this accommodation of the flat panel display, the '168 patent is believed to teach the user of a timing controller, a panel data converter, and a half-frame buffer. The timing controller issues wait signals to the CRT controller to allow forced synchronization with the necessary flat panel timing. The panel data converter converts the data provided by the program from its CRT format to the format required by the flat panel display. Finally, the half-frame buffer allows the data which is provided by the CRT controller and data which has been stored in the half-frame buffer to be alternately selected for writing to the flat panel. This is believed to allow the data to be supplied to the dual-panel flat-panel display in an order conforming to the requirements of the flat-panel display.

A conventional flat panel display architecture for a computer system using a dual-panel display is seen in FIG. 1

(designated as prior art). This architecture uses a virtual two-dimensional memory array 10 of discreet memory locations within a dynamic random access memory (DRAM) 12 to store pixel bit values for display data to be displayed as a visible image on a dual panel flat panel LCD display 14. The LCD display 14 includes an upper panel (**14*u*) and a lower panel (14*l*) so related to one another that they appear as a single display to a user of the computer system. Each of the panels define picture elements (or pixels) arranged in plural rows and columns of pixels. The pixels of the upper and lower panels are refreshed (as opposed to updated with new image information) pixel-by-pixel simultaneously. Pixels in a row of each panel are refreshed sequentially across the row, followed by refreshing of the next row of the panel, also pixel-by-pixel. That is, pixel $u_1$ of the upper panel is refreshed with image information corresponding to the memory location $u_1$ of the virtual memory array 10 at the same time that pixel $l_1$ is refreshed with image information corresponding to location $l_1$ of the virtual memory array 10. Next, pixels $u_2$ and $l_2$ are refreshed simultaneously, and so on across all of the rows of the panels 14*u* and 14*l***.

Conventionally, in order to achieve this simultaneous refreshing of two pixels at a time with a DRAM which is single-ported and allows only a single discrete memory location to be accessed at a particular time, the conventional computer system uses a sequencer (SEQ) 16 which controls accesses to the DRAM 12. This sequencer 16 allows a display first-in-first-out (FIFO) memory 18 to access one or a number of pixel values in sequence during a single memory access. The pixel values at this point will be four bits per pixel for a 16-color image, and eight bits per pixel for a 256-color image. From the display FIFO 18, the pixel values are routed through a processor (PROC) 20. The processor 20 determines color palette and other values for each pixel, and these will be supplied to the flat panel LCD display as single-bit-per-pixel values. Those ordinarily skilled in the pertinent arts will recognize that there is some inherent processing time required for this conversion from four or more bits per pixel to the single-bit-per-pixel format. Color separation and frame rate modulation will be used to control the colors and color intensities (i.e., equivalent to grey-scale values) of the pixels actually displayed on the LCD 14.

The single-bit-per-pixel values are supplied sequentially in serial format from the processor 20 to the display 14, first for one panel, writing pixels $u_1$ through $u_n$, for example, and then writing pixels $l_1$ through $l_n$ for the other panel. The frame rate modulation function provides the pixel values in a serial stream, every other pixel of which is directed to the LCD panel being refreshed. The other alternate pixel values are "predicted" pixel values needed for the refreshing of the panel by the half-frame buffer in order to control colors and color intensities. These alternate pixels (that is, ever other pixel value) are directed by the half-frame buffer into a memory location of the DRAM 12.

A pair of switch junctions 22 are used to direct the pixel bits to the appropriate display panel. During the writing of these pixels to the panel 14, a half-frame buffer 24 is employed to sequentially direct every other pixel value to the pane being refreshed, and to direct the alternate "predicated" pixel values to the DRAM 12 for temporary storage. These "predicted" pixel values are written to a second virtual memory array space 26 of the DRAM 12. It will be understood that the writing of the single-bit-per-pixel values into array space 26 cannot and does not occur simultaneously with the reading of pixel values from array space 10. The sequencer 16 arbitrates the time availability of access to DRAM 10 to allow these readings from and writing to the DRAM 10 to be accomplished. The circuitry including sequencer 16, display FIFO 18, processor 20, switch junctions 22, and half-frame buffer 24 may ordinarily be referred to collectively as a "display pipeline".

As the "predicated" pixel values for one of the panels **14*u* or 14*l* are written into the memory space 26, the values for the other of these panels will be supplied by the processor 20. However, the half-frame buffer 24 first reads a previously stored "predicted" pixel value from the memory space 26 and supplies this value to the one panel of display 14 before overwriting this memory location with a single-bit-per-pixel "predicted" pixel value being supplied by the processor for future use in refreshing the panel at the moment receiving pixel values directly form the processor. In this way, each panel 14*u* and 14*l* is alternately refreshed with data from the DRAM space 10, and with data from the DRAM space 26 (i.e., with the "predicted pixel values"). It will be appreciated that simply recalling data from the DRAM space 26 and using this data to refresh one of the panels 14*u* or 14*l* does not require the processing overhead associated with refreshing from DRAM space 10. Ordinarily, this reading and overwriting with new pixel value data at the DRAM space 26 will occur 32 bits at a time, with the half-frame buffer 24** being supplied with sufficient internal memory to accommodate this group-by-group processing of the pixel bits. The above-described conventional way of refreshing a color dual-panel LCD provides a display with good color rendition which is substantially free of flicker. However, the implementation of this display technology in a conventional computer system requires considerable complexity and expense.

SUMMARY OF THE INVENTION

In view of the deficiencies of conventional dual-panel color liquid crystal displays, a primary object for this invention is to avoid one or more of these deficiencies.

Another object for this invention is to provide a computer system with a dual-panel monochrome or color LCD which is refreshed one panel at a time, without refreshing of the other panel, with the panels being alternatingly refreshed.

Further, it is an object of the present invention to provide such a computer system in which the one panel of a dual-panel display which is not refreshed is blanked.

Accordingly, the present invention provides a computer system including a color dual-panel liquid crystal display (LCD) having a pair of LCD display panels operatively associated with one another so as to appear to be a single LCD display, each one of the pair of LCD display panels having plural pixel locations; a dynamic random access memory (DRAM) having a virtual memory space with plural memory locations, the plural memory locations corresponding to the plural pixel locations of the pair of LCD display panels; a display pipeline for sequentially reading plural memory locations of the DRAM corresponding to all pixel locations of one of the pair of LCD panels and sequentially writing corresponding pixel values to corresponding pixel locations of the one LCD display panel, and then sequentially reading plural memory locations of the DRAM corresponding to all pixel locations of the other of the pair of LCD panels and sequentially writing corresponding pixel values to corresponding pixel locations of the other LCD display panel; the display pipeline including switch means for alternatingly directing plural pixel values in sequence from the DRAM to one of the pair of LCD display panels, and then directing plural pixel values in sequence from the DRAM to the other of the pair of LCD display panels, and for simultaneously blanking the one of the pair of LCD display panel which is not being written to by the display pipeline.

In view of the above, it is apparent that the present invention involves the refreshing of a dual-panel LCD color display one panel at a time, alternatingly between the two panels, with the non-refreshed panel being blanked. The blanked panel is still readable. The applicants have discovered that the appearance of a dual-panel LCD display according to the invention is surprisingly similar to that of a conventional dual-panel color LCD display with simultaneous refreshing of both panels. A display according to the present invention does not flicker, but may require a differing contrast setting than would be required were both panels refreshed simultaneously. A power saving for the computer system may be experienced by use of the present invention, which power saving may be realized by full time use of the present alternating refreshments of the dual panel LCD, or may be employed as a power saving mode of a computer system which normally refreshed both panels of the LCD simultaneously in another mode of operation. When such a shift between modes of panel operation (simultaneous refreshing of both panels versus alternating refreshing and blanking), then an automatic adjustment of contrast level by adjusting of panel bias level may be effected when the shift between modes of panel operation is effected. This automatic adjustment of panel contrast level will provide the user with a similar appearance of the panel image in each mode of panel operation without the user having to manually adjust a contrast control for the panel.

BRIEF DESCRIPTION OF THE DRAWING FIGURES

FIG. 1 provides a functional block diagram of portion of a conventional computer system using a conventional dual-panel LCD with simultaneous refreshing of both panels.

FIG. 2 provides a pictorial presentation of a computer system embodying the present invention;

FIG. 3 is a functional block diagram of a portion of the computer system embodying the present invention.

DETAILED DESCRIPTION OF A PREFERRED EXEMPLARY EMBODIMENT OF THE INVENTION

Figure 1:
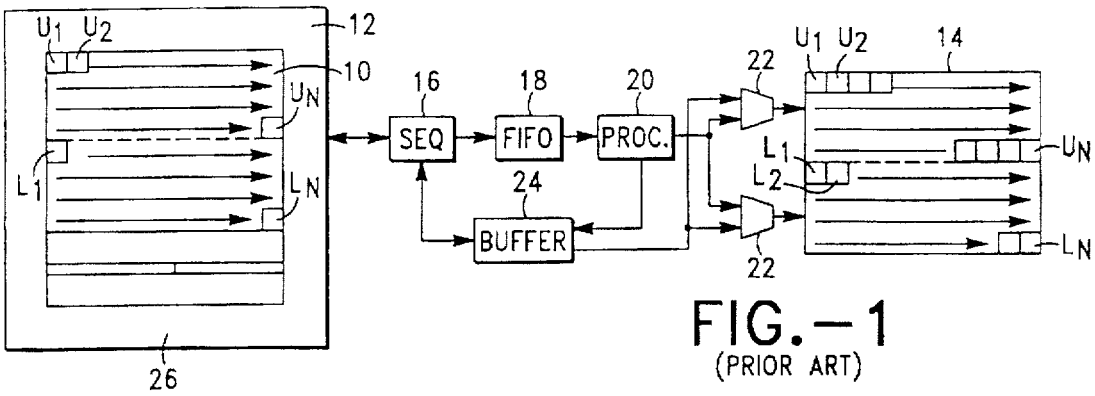
FIG.—1 (PRIOR ART)

Viewing FIG. 1, a computer system 28 of notebook configuration includes a monochrome or color liquid crystal display (LCD) 14' (see explanation below about primed reference numerals). As explained above, this display 14' is of dual-panel color LCD type, and includes an upper panel *14u'* and a lower panel *14l'*. The panels of the display 14' are so related to one another that to a user of the computer 28, there appears only a single display screen. The display 14' provides a visible image as an output of computer data to a user (not seen in the drawing Figures) of the computer system 28. The notebook computer includes various input devices, such as a keyboard 30, a floppy disk drive 32, and a track ball 34. Those ordinarily skilled in the pertinent arts will recognize that the track ball 34 is essentially a stationary mouse input device. The computer system 28 may include additional conventional input devices, such as a hard disk drive, a CD-ROM, and a serial input-output (I/O) port (none of which are seen in the drawing Figures). Several of these devices also function as output devices for the computer system 28 in addition to the liquid crystal display 14'.

Figure 3:
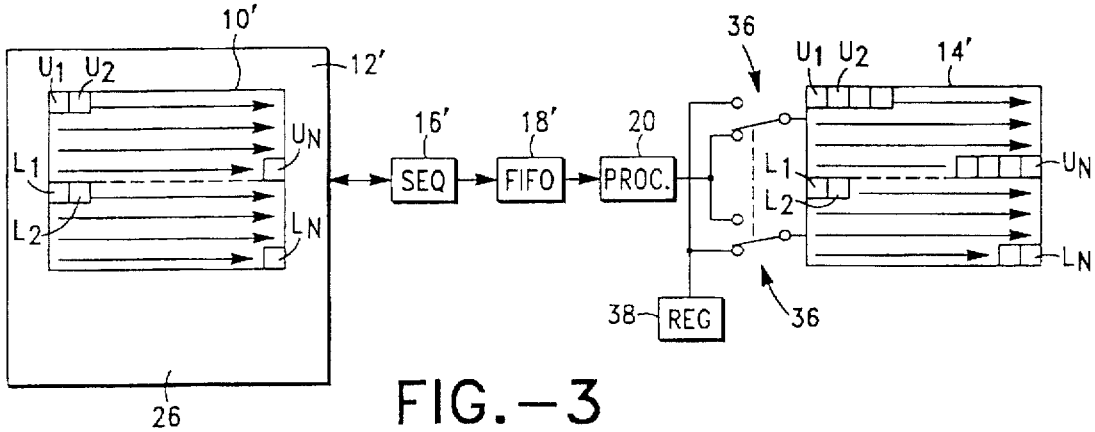

FIG. 3 provides a schematic functional block diagram of the portion of the computer system 28 which is analogous to that prior are portion seen in FIG. 1. In order to obtain reference numerals for use in describing the structure seen in FIG. 3, features which are the same as, or which are analogous in structure or function to, features described above are referenced on FIG. 3 with the same numeral used above, and having a prime (') added thereto. Viewing FIG. 3, it is seen that the computer 28 also uses a virtual two-dimensional memory array 10' of discreet memory locations within a dynamic random access memory (DRAM) 12' to store pixel bit values for display data to be displayed as a visible image on the dual panel flat panel LCD display 14'.

As was explained above, each of the panels *14u* and *14l* define picture elements (or pixels) arranged in plural rows and columns of pixels. The pixels of the upper and lower panels are refreshed pixel-by-pixel individually in each panel. However, the panels *14u'* and *14l'* are not refreshed simultaneously. Pixels in a row of a particular one of the two panels *14u* and *14l* are individually refreshed sequentially across the row, followed by refreshing of the next row of the panel, also pixel-by-pixel until the entire panel is refreshed. The data for refreshing each panel *14u* and *14l* is obtained from the virtual memory space 10' via the display pipeline of sequencer 16', display FIFO 18', processor 20', and a multiplexer 36, which is indicated schematically as a pair of switches 36 so linked (as depicted by a dashed line in FIG. 3) that they dither alternately between open and closed conditions in opposition to one another. That is, when one switch 36 is closed, the other switch is open. These switches 36 serve the same function as junction switches 22 (i.e., directing display data to the appropriate one of the panels *14u'* and *14l'*), but do not provide an interface for a half-frame buffer. That is, the inventive computer system 28 need not employ a half-frame buffer 24 nor the memory space 26 like the conventional computer system described above.

As was explained above, the conventional way of producing pixel values is as a series of pixel bits, every other one of which is supplied to a panel being refreshed, and the other alternate pixel bit values being "predicted" values which are stored temporarily for use in refreshing the panel. Instead, of generating "predicted" pixel values, according to the present invention, only the pixel values for refreshing a panel directly are generated in a frame rate modulator. The time intervals during which the "predicted" pixel values would conventionally be generated are simply left blank. That is a null or empty time interval is left in the serial pixel value stream. A selected pixel value (either a one or a zero) will be inserted into each of these blank time intervals, as is explained further. That is, the switches 36, when not connecting a particular panel *14u* or *14l* to the display pipeline (i.e., to processor 20), connect the particular display panel to a register 38. Depending on the polarity of operation of panel 14, the register 38 will provide values of all ones or all zeros to the blank pixel locations in the serial stream of pixel being provided to the panel 14.

Moreover, pixel $u_1$ of the upper panel *14u'* is refreshed with image information corresponding to the memory location $u_1$ of the virtual memory array 10'. Next, pixel $u_2$ is refreshed, and so on across all of the rows of the panel *14u'*. While the upper panel *14u'* is being refreshed, the lower panel *14l'* is simply blanked. That is, this panel *14l'* is not refreshed, but has all of the pixels written at a pixel value of all ones or all zeros from register 38 (i.e., dependent on whether all ones or all zeros are inserted into the blank time intervals between the pixel values provided by the frame rate modulator of the processor 20). Next, the pixels of the lower panel *14l'* are refreshed, while the pixels of the upper panel 14u' are simply blanked (written at a pixel value of all ones or all zeros). The panels 14u' and 14l' simply alternate in this way of being refreshed and blanked alternately and in opposition to one another.

Figure 2:
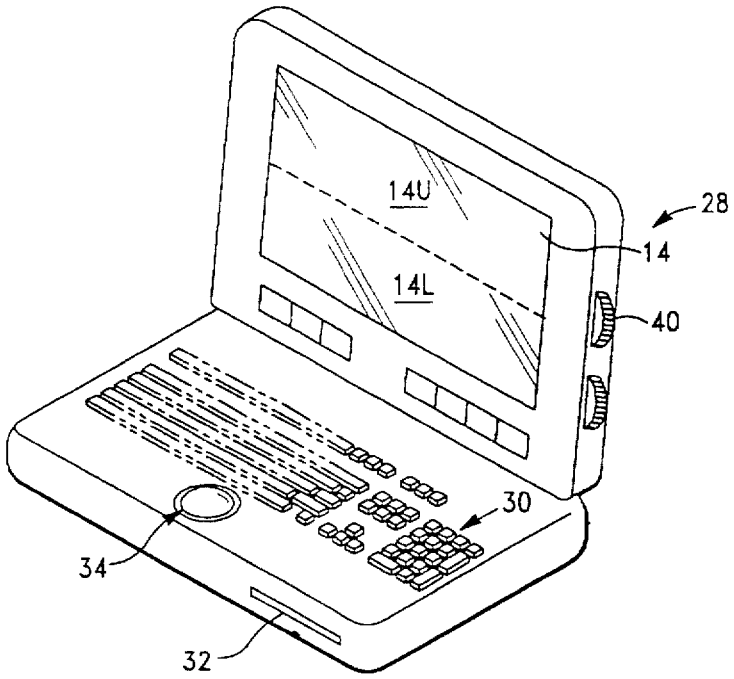

The applicants have discovered to their surprise that the quality of color image provided by the display 14' is very much comparable favorably to the image provided by a conventional color dual-panel LCD display. It will be seen that because no part of the DRAM 12' is used to create a virtual memory space like space 26 seen in FIG. 1, a larger proportion of the DRAM space is available for other uses. Also, it is believed that there is a significant power saving for the computer of FIGS. 2 and 3 compared to a computer using the conventional way of driving a color dual-panel LCD display. It will be seen that the processor need not generate "predicted" pixel values as is the case with a conventional dual-panel LCD display. This represents a considerable saving in processing required to operate the LCD.

It will be understood that a single computer system may be configured, if desired, to employ both the conventional way (recalling FIG. 1) of driving a color dual-panel LCD display, and with a power saving mode which when activated drives the display with circuitry as depicted in FIG. 3. When the computer switches from one mode of driving the display to the other, there may be a change in the contrast of the displayed image. In this case, the user may adjust the image contrast using a manual control 38 provided on the display portion of the computer case. Manual adjustment of this control changes a bias voltage value applied to the display 14'. Alternatively, a circuit may be provided within the computer 28 which automatically provides a different bias voltage value to the display 14' dependent upon which one of the display drive modes in being used so that the image contrast apparent to the user does not change excessively when the computer goes into and out of its power saving mode.

Of course it will be obvious to those of ordinary skill in the relevant art, after study of the description set forth above in conjunction with the drawings, that principles, features and methods of operation of the described computer system with dual-panel LCD display and methods may be readily applied to other systems and devices, including but not limited to intelligent devices incorporating a display, embedded micro-controllers incorporating a user display, and intelligent input/output processing mechanisms including a display.

While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. For example, it is apparent that the present invention may be used to equal beneficial effect with monochrome LCD displays. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. A computer system comprising:

a dual-panel liquid crystal display (LCD) having a pair of LCD display panels operatively associated with one another so as to appear to be a single LCD display, each one of said pair of LCD display panels having plural pixel locations;

a dynamic random access memory (DRAM) having a virtual memory space with plural memory locations, said plural memory locations corresponding to said plural pixel locations of said pair of LCD display panels;

a display pipeline for sequentially reading plural memory locations of said DRAM corresponding to all pixel locations of one of said pair of LCD panels and sequentially writing corresponding pixel values to corresponding pixel locations of said one LCD display panel, and then sequentially reading plural memory locations of said DRAM corresponding to all pixel locations of the other of said pair of LCD panels and sequentially writing corresponding pixel values to corresponding pixel locations of said other LCD display panel;

said display pipeline including switch means for alternatingly directing plural pixel values in sequence from said DRAM to one of said pair of LCD display panels, and then directing plural pixel values in sequence from said DRAM to the other of said pair of LCD display panels, and for simultaneously blanking the one of said pair of LCD display panel which is not being written to by said display pipeline.

2. The computer system of claim 1 further including a register selectively providing a pixel value of one or zero to all pixels of the one of said pair of panels which is not being written to by said display pipeline.

3. The computer system of claim 1 wherein said display pipeline includes a sequencer arbitrating access to said DRAM.

4. The computer system of claim 3 wherein said display pipeline includes a display first-in-first-out (FIFO) memory receiving display data from said DRAM via said sequencer.

5. The computer system of claim 4 wherein said display pipeline includes a processor receiving display data from said DRAM via said sequencer and said display FIFO in multi-bit per pixel format and providing to said display panel display data in single-bit-per-pixel format.

6. The computer system of claim 1 wherein said switch means includes a pair of switches each respectively feeding display data to a respective one of said pair of display panels, and means dithering said pair of switches alternatingly open and closed in opposition to one another so as to route display data from said DRAM to the appropriate one of said display panels.

7. A computer system comprising: a dual-panel liquid crystal display (LCD) having a pair of LCD display panels operatively associated with one another so as to appear to be a single LCD display, each one of said pair of LCD display panels having plural pixel locations; a dynamic random access memory (DRAM) having a virtual memory space with plural memory locations, said plural memory locations corresponding to said plural pixel locations of said pair of LCD display panels; a display pipeline for sequentially reading plural memory locations of said DRAM corresponding to all pixel locations of one of said pair of LCD panels and sequentially writing corresponding pixel values to corresponding pixel locations of said one LCD display panel, and then sequentially reading plural memory locations of said DRAM corresponding to all pixel locations of the other of said pair of LCD panels and sequentially writing corresponding pixel values to corresponding pixel locations of said other LCD display panel; said display pipeline including switch means for alternatingly directing plural pixel values in sequence from said DRAM to one of said pair of LCD display panels, and then directing plural pixel values in sequence from said DRAM to the other of said pair of LCD display panels, and a register for simultaneously blanking the one of said pair of LCD display panel which is not being written to by said display pipeline; said switch means including a pair of switches each respectively feeding display data to a respective one of said pair of display panels and pixel-blanking values from said register to the other of said pair of panels, and means dithering said pair of switches alternatingly open and closed in opposition to one another so as to route display data from said DRAM to the appropriate one of said display panels.

8. The computer system of claim 7 wherein said display pipeline includes a sequencer arbitrating access to said DRAM.

9. The computer system of claim 8 wherein said display pipeline includes a display first-in-first-out (FIFO) memory receiving display data from said DRAM via said sequencer.

10. The computer system of claim 9 wherein said display pipeline includes a processor receiving display data from said DRAM via said sequencer and said display FIFO in multi-bit per pixel format and providing to said display panel display data in single-bit-per-pixel format.

11. A dual-panel liquid crystal display (LCD) system, comprising:

first and second liquid crystal display panels for displaying first and second parts of a picture respectively; and display signal generating means for alternatingly applying first picture signals to the first liquid crystal display panel while blanking the second liquid crystal display panel, and applying second picture signals to the second liquid crystal display panel while blanking the first liquid crystal display panel, at a sufficiently high rate to avoid flicker.

12. A system as in claim 11, in which:

the first and second picture signals comprise first and second pixel signals respectively; and the display signal generating means applies the first and second pixel signals to the first and second liquid crystal display panels serially.

13. A system as in claim 12, in which the display signal generating means serially applies all of the first pixel signals to the first liquid crystal display panel while blanking the second liquid crystal display panel, and serially applies all of the second pixel signals to the second liquid crystal display panel while blanking the first liquid crystal display panel.

14. A system as in claim 12, in which the display signal generating means comprises:

memory means for storing the first and second pixel signals; and display pipeline means for reading the first and second pixel signals out of the memory means and applying the first and second pixel signals to the first and second liquid crystal display panels respectively.

15. A system as in claim 14, in which the memory means stores the first and second pixel signals in first and second sections thereof.

16. A system as in claim 14, in which the display signal generating means further comprises switching means for alternatingly switching an output of the display pipeline means to inputs of the first and second liquid crystal panels.

17. A system as in claim 16, in which:

the display signal generating means further comprises blanking means for generating blanking pixel signals for blanking the first and second liquid crystal display panels; and the switching means further switches an output of the blanking means to the second liquid crystal display panel while switching the output of the display pipeline means to the first liquid crystal display panel, and switches the output of the blanking means to the first liquid crystal display panel while switching the output of the display pipeline means to the second liquid crystal display panel.

18. A system as in claim 14, in which:

the first and second pixel signals are stored in the memory means in multi-bit-per-pixel format; and the display pipeline means comprises processing means for converting the first and second pixel signals into single-bit-per-pixel format.

19. A method of displaying a picture on a dual-panel liquid crystal display (LCD) system having first and second liquid crystal display panels for displaying first and second parts of the picture respectively, comprising the step of:

(a) alternatingly applying first picture signals to the first liquid crystal display panel while blanking the second liquid crystal display panel, and applying second picture signals to the second liquid crystal display panel while blanking the first liquid crystal panel, at a sufficiently high rate to avoid flicker.

20. A method as in claim 19, in which:

the first and second picture signals comprise first and second pixel signals respectively; and step (a) comprises applying first and second pixel signals to the first and second liquid crystal display panels serially.

21. A method as in claim 20, in which step (a) comprises serially applying all of the first pixel signals to the first liquid crystal display panel while blanking the second liquid crystal display panel, and serially applying all of the second pixel signals to the second liquid crystal display panel while blanking the first liquid crystal display panel.

22. A method as in claim 20, in which step (a) comprises the substeps of:

(b) storing the first and second pixel signals in a memory;

(c) reading the stored first and second pixel signals out of the memory; and (d) applying the first and second pixel signals to the first and second liquid crystal display panels respectively.

23. A method as in claim 22, in which step (b) comprises storing the first and second pixel signals in first and second section of the memory.

24. A method as in claim 22, in which step (d) comprises alternatingly switching an output of the memory to inputs of the first and second liquid crystal panels.

25. A method as in claim 24, in which step (d) comprises the substeps of:

(e) generating blanking pixel signals for blanking the first and second liquid crystal display panels;

(f) applying the blanking pixel signals to the second liquid crystal display panel while applying the first pixel signals to the first liquid crystal display panel; and (g) applying the blanking pixel signals to the first liquid crystal display panel while applying the second pixel signals to the second liquid crystal display panel.

26. A method as in claim 22, in which:

step (b) comprises storing the first and second pixel signals in the memory in multi-bit-per-pixel format; and step (d) further comprises converting the first and second pixel signals into single-bit-per-pixel format.

* * * * *

UNITED STATES PATENT AND TRADEMARK OFFICE

CERTIFICATE OF CORRECTION

PATENT NO. : 5,724,063

DATED : March 3, 1998

INVENTOR(S) : Lawrence Chee, et al.

It is certified that errors appear in the above identified patent and that said Letters Patent is hereby corrected as shown below:

Column 2, line 53: Change "user" to --use--.

Column 3, line 60: Change ""predi-" to --"pre--.

Column 3, line 61: Change "cated"" to --dicted"--.

Column 4, line 1: Change "10" to --12--.

Column 4, line 2: Change "10" to --12--.

Column 4, line 6: Change ""predicated"" to --"predicted"--.

Column 5, line 44: Change "FIG. 1" to --FIG. 2--.

Column 7, line 22: Delete "with".

Column 7, line 27: Change "38" to --40--.

Signed and Sealed this

Thirtieth Day of November, 1999

*Attest:*

*Attesting Officer*

Q. TODD DICKINSON

*Acting Commissioner of Patents and Trademarks*